US006213293B1

(12) United States Patent
Marco

(10) Patent No.: US 6,213,293 B1
(45) **Date of Patent: *Apr. 10, 2001**

(54) FILM MULTIPACKAGE

(75) Inventor: Leslie S. Marco, Bloomingdale, IL (US)

(73) Assignee: Illinois Tool Works Inc., Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,428

(22) Filed: Dec. 24, 1998

(51) Int. Cl.[7] ..... B65D 75/00

(52) U.S. Cl. ..... 206/147; 206/151; 206/161; 206/170; 206/434; 294/87.2

(58) Field of Search ..... 206/145, 147, 206/150, 151, 155, 161, 170, 174, 201, 427, 430, 434, 497, 432; 53/48.3, 48.4, 172, 176; 294/87.2

(56) References Cited

U.S. PATENT DOCUMENTS

| | | | | |
|---|---|---|---|---|
| 2,654,474 | | 10/1953 | Ringler . | |
| 2,701,661 | | 2/1955 | Murray . | |
| 2,946,621 | * | 7/1960 | Williamson | 206/150 |
| 3,084,792 | * | 4/1963 | Poupitch | 206/150 |
| 3,118,537 | * | 1/1964 | Copping | 206/432 |
| 3,198,327 | * | 8/1965 | Boehling et al. | 206/497 |
| 3,200,944 | * | 8/1965 | Rapata | 206/497 |
| 3,214,016 | * | 10/1965 | Stephan | 206/497 |
| 3,217,874 | * | 11/1965 | Potter | 206/497 |
| 3,325,004 | | 6/1967 | Wanderer . | |
| 3,410,596 | * | 11/1968 | Slevin, Jr. | 206/150 |
| 3,460,863 | | 8/1969 | Schaich . | |
| 3,899,076 | * | 8/1975 | Florian | 206/427 |
| 4,378,879 | * | 4/1983 | Killy | 206/158 |
| 4,403,689 | | 9/1983 | Wood . | |
| 4,560,064 | | 12/1985 | Peterson et al. . | |
| 4,637,515 | * | 1/1987 | Wilson et al. | 206/434 |
| 4,779,731 | * | 10/1988 | Fujio | 206/432 |
| 4,807,751 | | 2/1989 | Klygis et al. . | |
| 4,828,110 | | 5/1989 | Lems . | |
| 4,932,528 | | 6/1990 | Benno . | |
| 5,305,877 | | 4/1994 | Olsen . | |
| 5,311,984 | * | 5/1994 | Harris | 206/140 |
| 5,328,024 | * | 7/1994 | Sutherland | 206/158 |
| 5,390,784 | * | 2/1995 | Sutherland | 206/148 |
| 5,425,446 | * | 6/1995 | Weaver et al. | 206/145 |
| 5,487,463 | | 1/1996 | Harris . | |
| 5,538,133 | | 7/1996 | Campbell et al. . | |
| 5,590,776 | | 1/1997 | Galbierz et al. . | |

FOREIGN PATENT DOCUMENTS

| | | |
|---|---|---|
| 1 013 564 A2 | 6/2000 | (EP) . |
| 2 015 754 | 4/1970 | (FR) . |
| 2169442 | 9/1973 | (FR) . |
| 93/14992 | 8/1993 | (WO) . |

* cited by examiner

*Primary Examiner*—Paul T. Sewell
*Assistant Examiner*—Shian Luong
(74) *Attorney, Agent, or Firm*—Pauley Petersen Kinne & Fejer

(57) ABSTRACT

This invention relates to a single-piece carrier for unitizing a plurality of containers with a retainer sheet integrated with a film sleeve. The retainer sheet may comprise a thicker material than the film sleeve. The retainer sheet comprises a plurality of container receiving openings for engaging a top portion of each container while the film sleeve surrounds the plurality of containers. Packages may comprise one or more layers of containers within the film sleeve.

14 Claims, 8 Drawing Sheets

FILM MULTIPACKAGE

BACKGROUND OF THE INVENTION

1. Field of the Invention

This invention relates to a single-piece carrier for unitizing a plurality of containers, the carrier having a retainer sheet for engaging a top portion of the containers integrated with a film sleeve for surrounding the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, the plastic ring carrier, when used alone, has little or no advertising or promotional printing space. Conversely, the box carrier generally has a relatively large amount of area for promotional graphics. Disadvantageously, the box carrier requires a relatively large amount of material, may permit containers to fall out if it is not maintained in an upright position, and usually shrouds most or all of the actual containers. Therefore, there is a need for a package that incorporates the stability and economy of a ring carrier and the promotional area of a box carrier.

SUMMARY OF THE INVENTION

It is one object of this invention to provide a container carrier that unitizes a plurality of containers into a tight, solid package.

It is another object of this invention to provide a container carrier that provides a prominent billboard space for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is still another object of this invention to provide a container carrier that utilizes a film sleeve to maintain a tight configuration of unitized containers.

A carrier according to this invention carries a plurality of containers such as cans or bottles. The carrier unitizes a plurality of containers to create a package. The carrier is a single-piece device comprising a retainer sheet integrated with a film sleeve, each preferably constructed from a flexible, resilient material such as plastic. The retainer sheet preferably has a first thickness different from and thicker than a second thickness of the film sleeve.

The retainer sheet is formed with a plurality of container receiving openings the number of which depends upon the intended size of the package. The retainer sheet is integrated with the film sleeve preferably along longitudinal sides of the retainer sheet.

The film sleeve may be designed to create a package open at a bottom of the package or along a lower edge of the carrier. The film sleeve may further include a bottom along a portion of the lower edge of the film sleeve. Each side edge of the film sleeve is preferably bound with a seal. The carrier when formed is preferably generally symmetrical around fold lines of the carrier.

Containers are inserted within the carrier so that the containers are surrounded by between five and six sides of the package. Each container receiving opening in the retainer sheet preferably engages a container around an upper portion of the container. The rigidity and elasticity of the retainer sheet thereby supports each container.

The film sleeve is positioned around the plurality of containers, preferably in a stretching engagement with the containers. The film sleeve is preferably printed with graphics, promotional and/or other information related to contents and/or ingredients of package. Therefore, the film sleeve serves both to unitize the plurality of containers and to advertise the nature of the contents of the containers.

The carrier is preferably manufactured according to one of several preferred methods wherein a generally continuous length of carriers is formed. In summary, a film substrate is printed with desired graphics and other merchandising information. A retainer sheet material is next joined to the film substrate by extrusion coating, laminating, profile extrusion or glueing the retainer sheet material to the film substrate. The joined retainer sheet material and film substrate are next either folded along a fold line to create a symmetrical double layer or laminated to an identical section of joined retainer sheet material and film substrate. Seams are next added by heat sealing or laminating the symmetrical double layer of retainer sheet material and film substrate together. Finally, the carrier is formed by die cutting the double layer of retainer sheet material and film substrate to create container receiving openings and to define a film sleeve and a retainer sheet.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
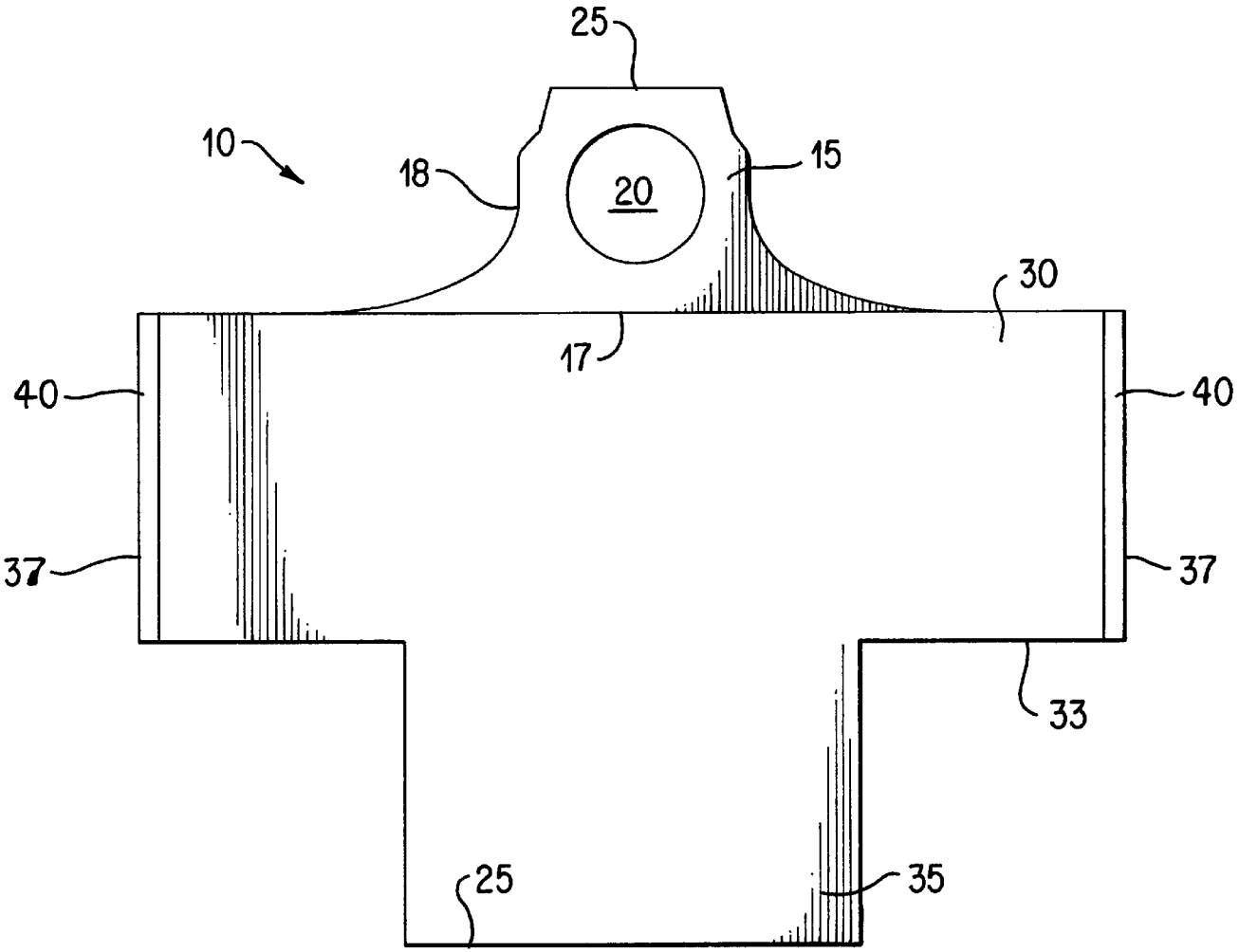
FIG. 1 is a top view of a carrier for holding a plurality of containers according to one preferred embodiment of this invention.
Figure 2:
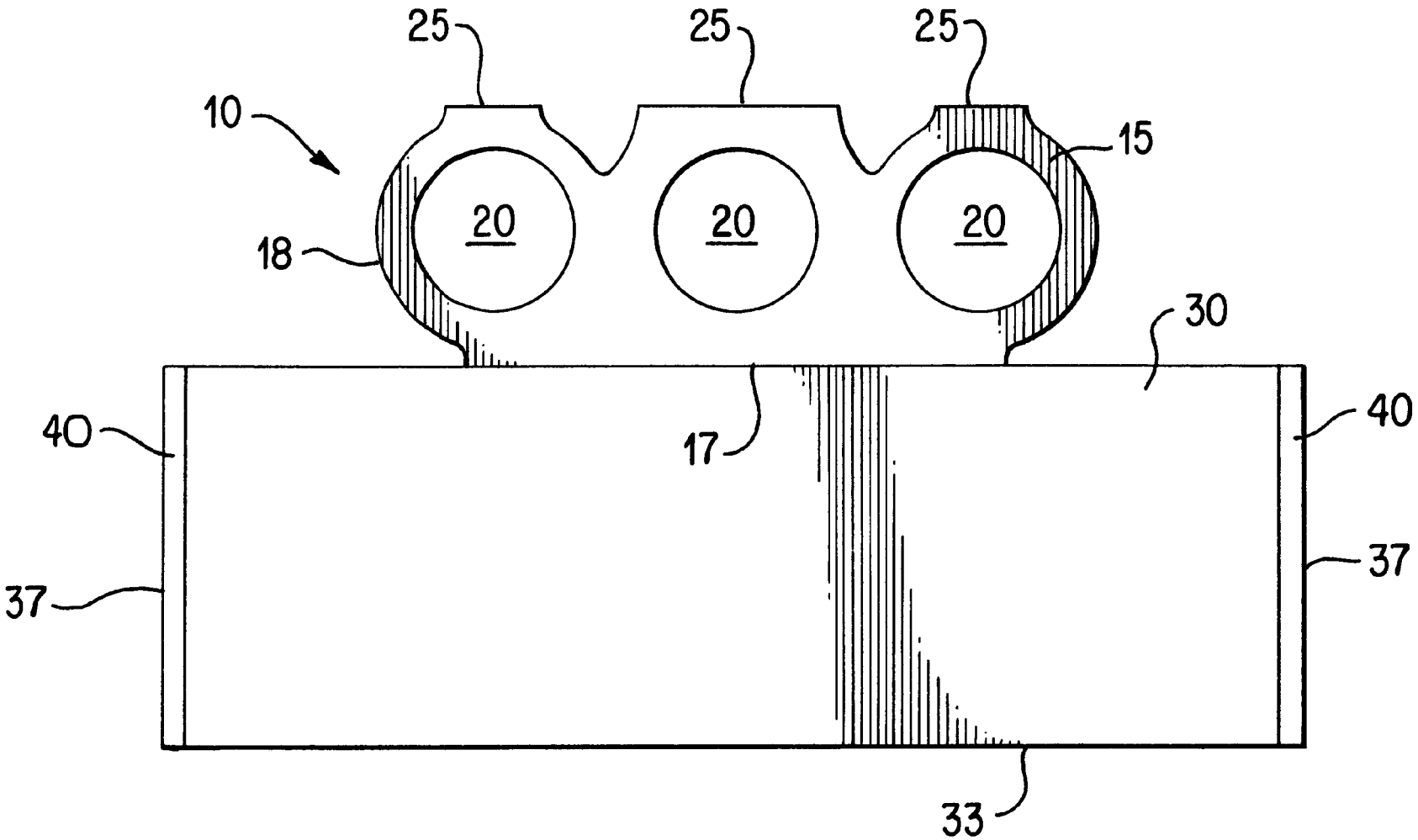
FIG. 2 is a top view of a carrier for holding a plurality of containers according to another preferred embodiment of this invention.
Figure 3:
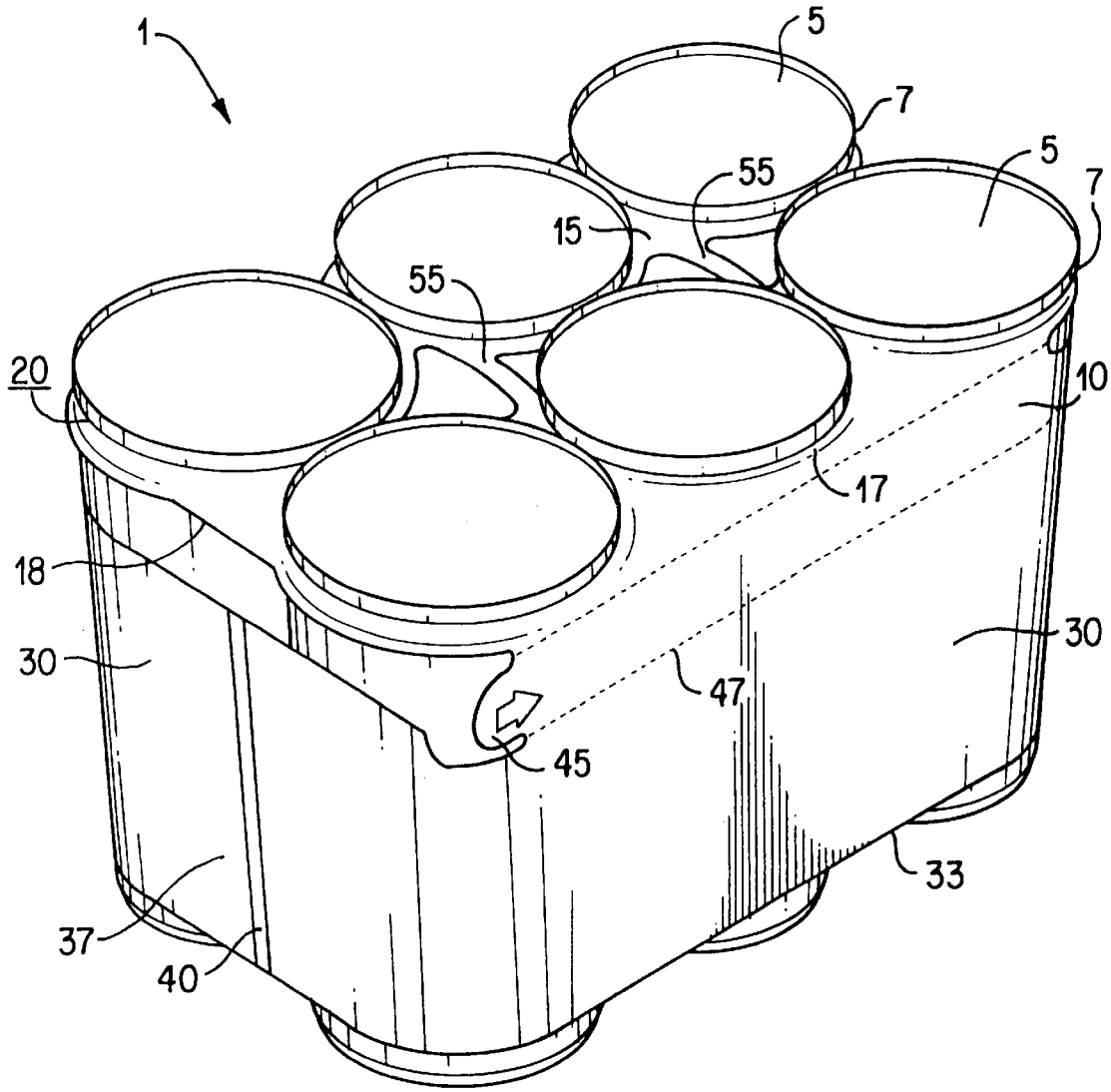
FIG. 3 is a perspective view of a package of containers, using a carrier similar to the carrier shown in FIG. 2, according to one preferred embodiment of this invention.
Figure 4:
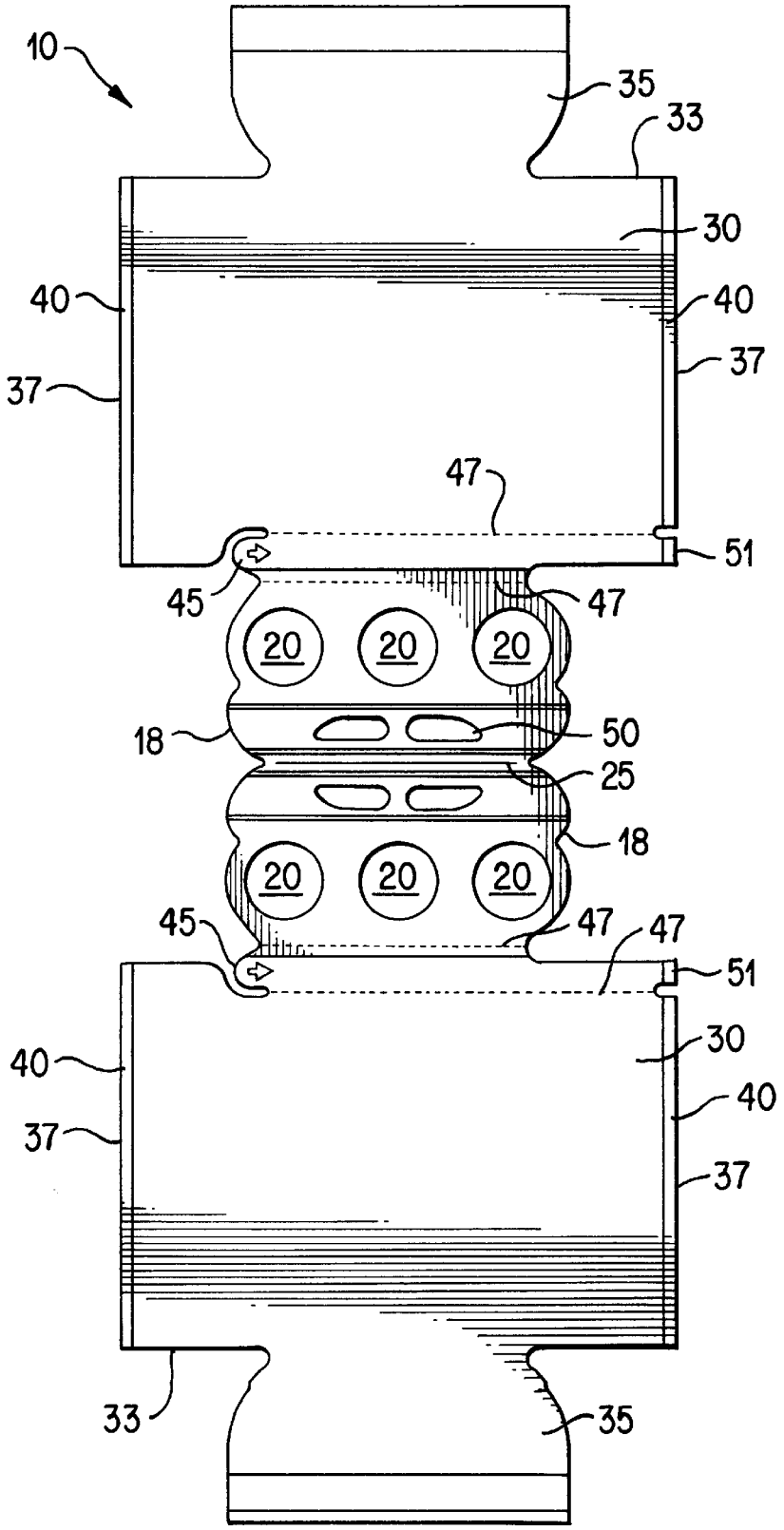
FIG. 4 is a top view of a carrier for holding a plurality of containers according to another preferred embodiment of this invention.

FIGS. 1–8 show carriers 10 for carrying a plurality of containers 5. Containers 5 as shown in FIGS. 3 and 4 are preferably cans. Although cans are shown in FIGS. 3 and 4, bottles or any other commonly unitized container 5 may be used with carrier 10 according to this invention. Containers 5 are preferably like-sized within a single carrier 10.

Figure 5:
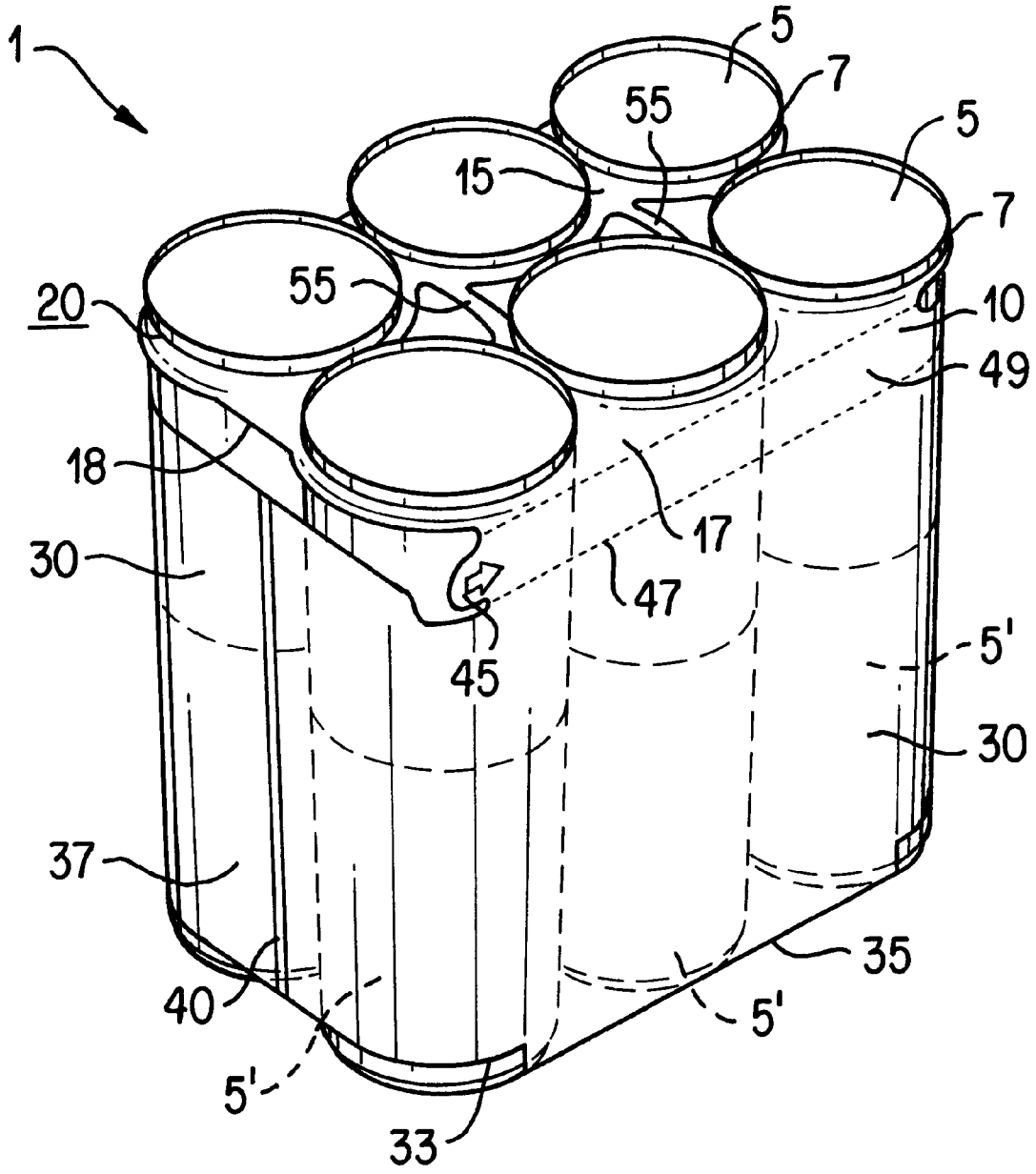
FIG. 5 is a perspective view of a package of containers, using a carrier similar to the carrier shown in FIG. 4, according to one preferred embodiment of this invention.

Carrier 10 unitizes a plurality of containers 5 to create package 1, such as package 1 shown in FIGS. 3 and 5. Carrier 10 is preferably a single-piece device comprising retainer sheet 15 integrated with film sleeve 30, each preferably constructed from a flexible, resilient material such as plastic. For the purposes of this specification and claims, a sleeve is defined as a tubelike component capable of fitting over or around a plurality of containers 5.

In one preferred embodiment of this invention, retainer sheet 15 is made from low density polyethylene. Retainer sheet 15 preferably has a first thickness, such as 0.008", preferably thinner than the thickness of traditional plastic ring carriers. As discussed in additional detail below, retainer sheet 15 is preferably cut, using means known to those skilled in the art such as a stamping die, to form a plurality of container receiving openings 20 in retainer sheet 15. Two or more container receiving openings 20 are formed in retainer sheet 15 in longitudinal rows and one or more transverse ranks. In one preferred embodiment of this invention shown in FIGS. 2–5, container receiving openings 20 are configured in two rows of three ranks. Retainer sheet 15 may include other configurations of container receiving openings 20 depending on the size of package 1 desired.

Retainer sheet 15 is integrated with film sleeve 30 to form a single-piece carrier 10, as described in detail below. Film sleeve 30 preferably has a second thickness that is thinner than the first thickness of retainer sheet 15, such as 0.004" to 0.006". The total thickness of retainer sheet 15 is approximately 0.012–0.014" according to one preferred embodiment of this invention. Film sleeve 30 preferably exhibits greater elasticity and less rigidity than retainer sheet 15. Film sleeve 30 may comprise a stretchable low density polyethylene (LDPE) film or similar material known to those having ordinary skill in the art.

Figure 6:
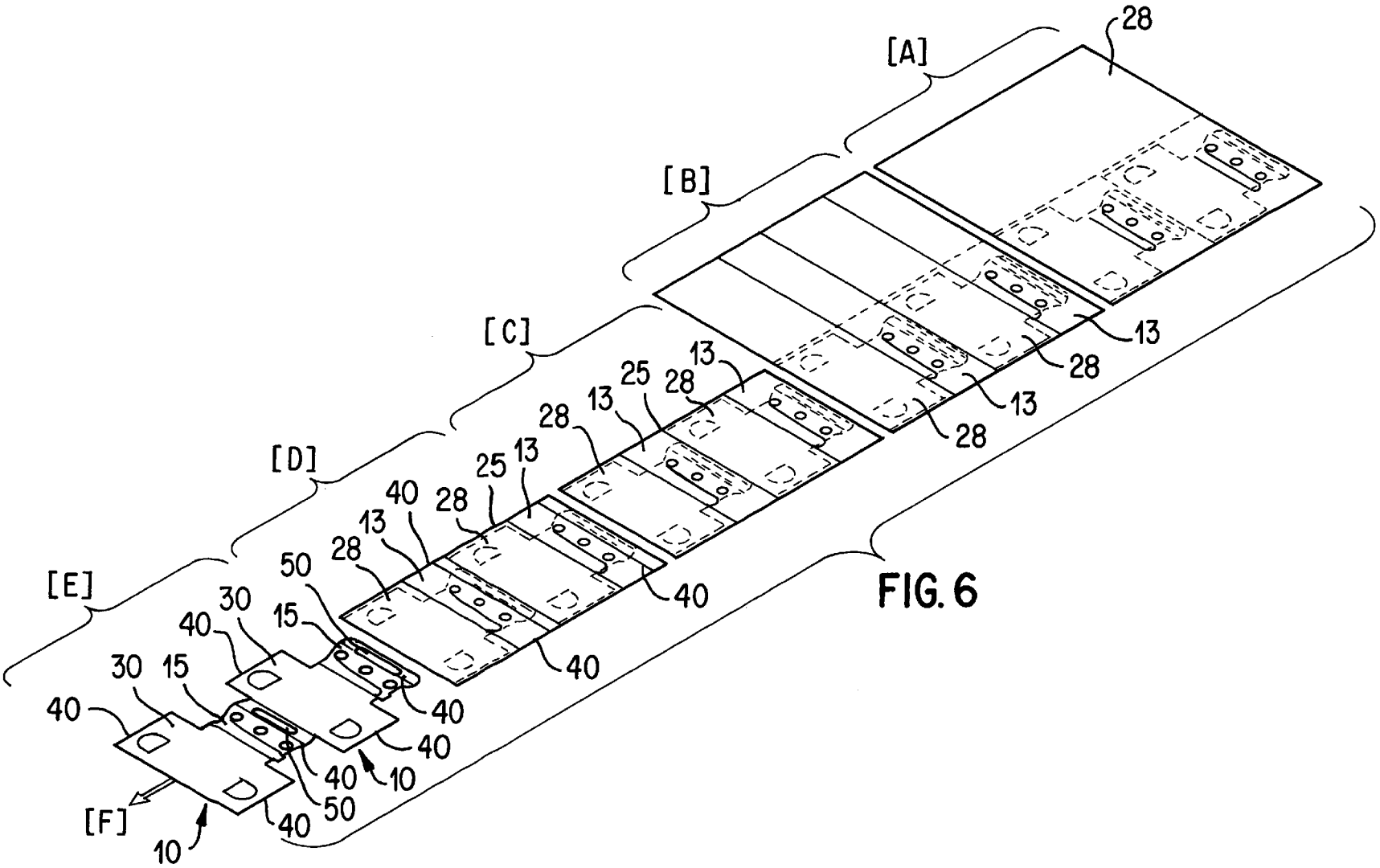
FIG. 6 is a schematic of a method for making a carrier for holding a plurality of containers according to one preferred embodiment of this invention.
Figure 8:
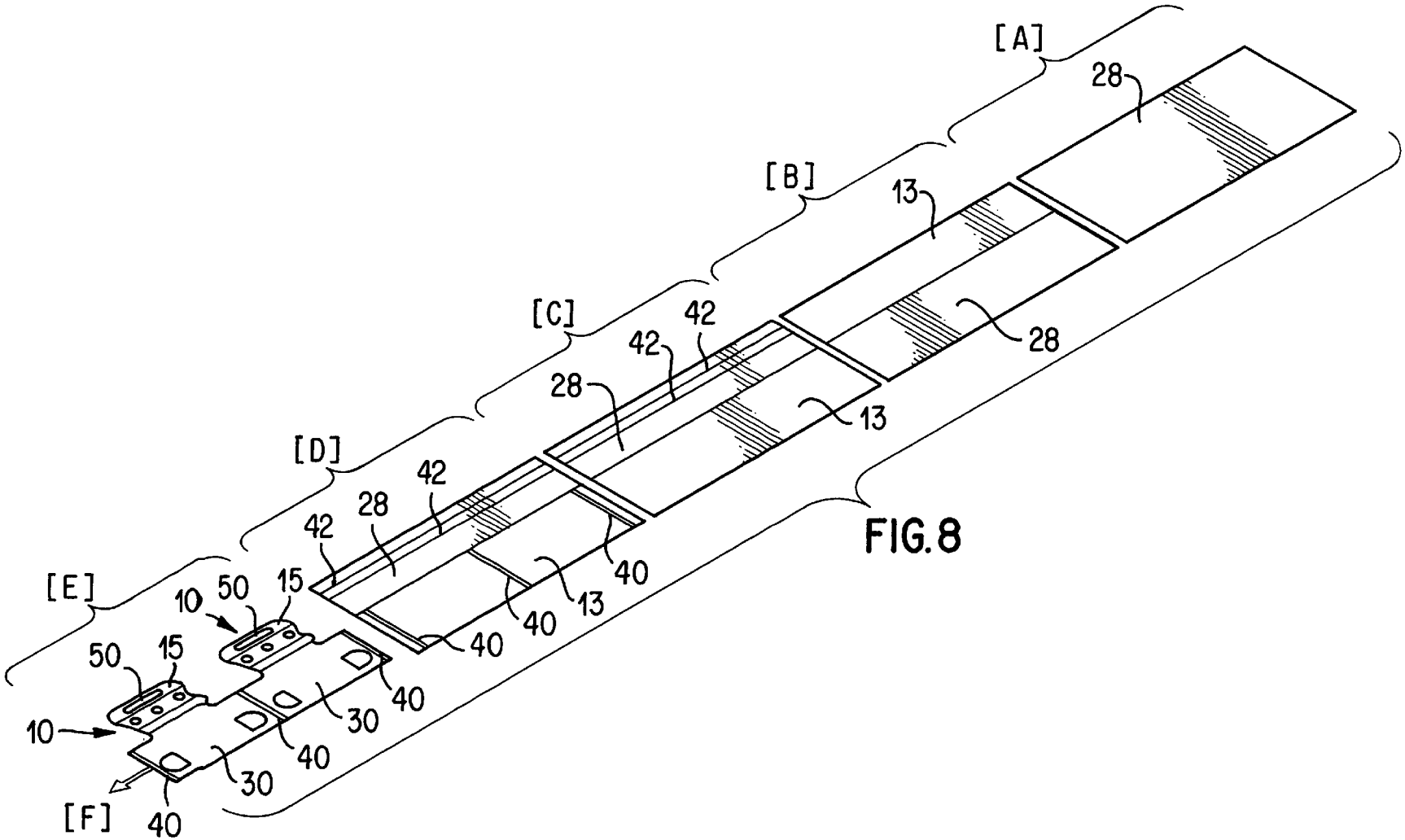
FIG. 8 is a schematic of a method for making a carrier for holding a plurality of containers according to yet another preferred embodiment of this invention.

In one preferred embodiment of this invention, shown in FIGS. 6 and 8, handle 50 is integrated within retainer sheet 15. Handle 50 preferably has a same or similar thickness as retainer sheet 15. In one preferred embodiment of this invention, shown in FIGS. 6 and 8, handle 50 is integrated between longitudinal rows of container receiving openings 20. Alternatively, package 1 may be carried using bands 55 formed between container receiving openings 20 as shown in FIGS. 3 and 5.

Film sleeve 30 is preferably integrated with retainer sheet 15 along longitudinal sides 17 of retainer sheet 15. In one preferred embodiment of this invention, film sleeve 30 is not connected along two lateral edges 18 of retainer sheet 15. Film sleeve 30 is preferably printed with, on one or both sides, UPC and proof of purchase labels, graphics, and promotional and/or other information related to contents and/or ingredients of package 1. Film sleeve 30 may additionally be at least partially transparent to effectively display nature of containers 5. Therefore, film sleeve 30 serves the dual purposes of retaining containers 5 within a tightly assembled package 1 and advertising marketable features of the containers 5 and/or package 1.

In one preferred embodiment of this invention shown in FIG. 2, film sleeve 30 is open along lower edge 33 of carrier 10. As shown in FIG. 1, lower edge 33 of carrier 10 may further include bottom 35 of film sleeve 30. Each side edge 37 of film sleeve 30 is preferably bound with seal 40. Therefore, film sleeve 30 extends from openable lower edge 33 of carrier to seals 40 on either side edge 37 of film sleeve to retainer sheet 15 at a top portion of carrier 10.

As shown in FIGS. 1 and 2, carrier 10 is preferably generally symmetrical around fold lines 25. As discussed in detail below, carrier 10 is manufactured so that retainer sheet 15 and film sleeve 30 are each preferably symmetrical around fold lines 25.

Carrier 10 is applied to a plurality of containers 5 to form package 1, shown in FIGS. 3 and 5. Containers 5 are inserted within carrier 10 which bounds containers 5 around between five and six sides of package 1. Each container receiving opening 20 preferably engages container 5, preferably around chime 7 or similar upper portion of container 5. The rigidity and elasticity of retainer sheet 15 supports container 5 within container receiving opening 20. A top portion of package 1 is therefore at least partially covered by retainer sheet 15.

As shown in FIGS. 3 and 5, film sleeve 30 is positioned around the plurality of containers 5. Preferably, film sleeve 30 is stretchingly engaged with containers 5 and the combination of container receiving openings 20 and sleeve 30 prevents skewing or lateral movement of containers 5 with respect to each other. In one preferred embodiment of this invention, shown in FIGS. 2 and 3, film sleeve 30 covers at least a portion of four vertical sides of package 1.

Containers 5 are positioned within package 1 so that film sleeve 30 is flat and tight with respect to containers 5 and prominent with respect to package 1. Film sleeve 30 is preferably sized to stretch when slid over a plurality of containers 5. Such a configuration of film sleeve 30 results in package 1 having a prominent display area or "billboard" for advertising, information, graphics and other marketing material.

In another preferred embodiment of this invention, shown in FIGS. 1, 4 and 5, film sleeve 30 covers at least a portion of a bottom of package 1. Film sleeve 30 preferably covers at least a portion of the bottom of package 1 when one or more containers 5 are not engaged with container receiving openings 20. For instance, carrier 10 shown in FIG. 1 requires bottom 35 because retainer sheet 15 includes only two container receiving openings 20 in carrier 10 that holds more than two containers 5. Carrier 10 shown in FIG. 5 also requires bottom 35 because, of the twelve containers 5 in package 10, the lower six containers 5' in package 1 are not supported around chime 7 by retainer sheet 15. Therefore, bottom 35 provides support for those containers 5 not supported within container receiving openings 20.

As shown in FIGS. 3–5, package 1 may additionally contain pull tab 45 and/or line of perforation 47 positioned within film sleeve 30. Using an arrangement such as shown in FIGS. 3–5, package 1 may be opened by pulling pull tab 45 across longitudinal side 17 of package 1 thereby tearing line of perforation 47 to access containers 5.

A package according to FIGS. 4 and 5 will have the novel characteristic of having an upper level of containers 5 removable from a lower level of container 5' while keeping the upper level of containers 5 integrated as a sub-package and permitting the lower level of containers 5' to be freely removable for individual consumption or storage.

According to one preferred embodiment of this invention, perforated removal strip 49 facilitates the efficient removal of the upper level of containers 5 and retainer sheet 15 from the lower level of containers 5 and sleeve 30. Perforated removal strip 49 is designed so a single pulling action of tab 45 circumferentially around package 1 will disassociate retainer sheet 15 and upper level of containers 5' from sleeve 30. Welded tabs 51 at an end panel of package 1 permit such single pulling action removal from either side of package 1. FIG. 6 shows carrier 10 according to this preferred embodiment, which is contemplated to be manufactured similar to FIG. 7, described below.

Figure 7:
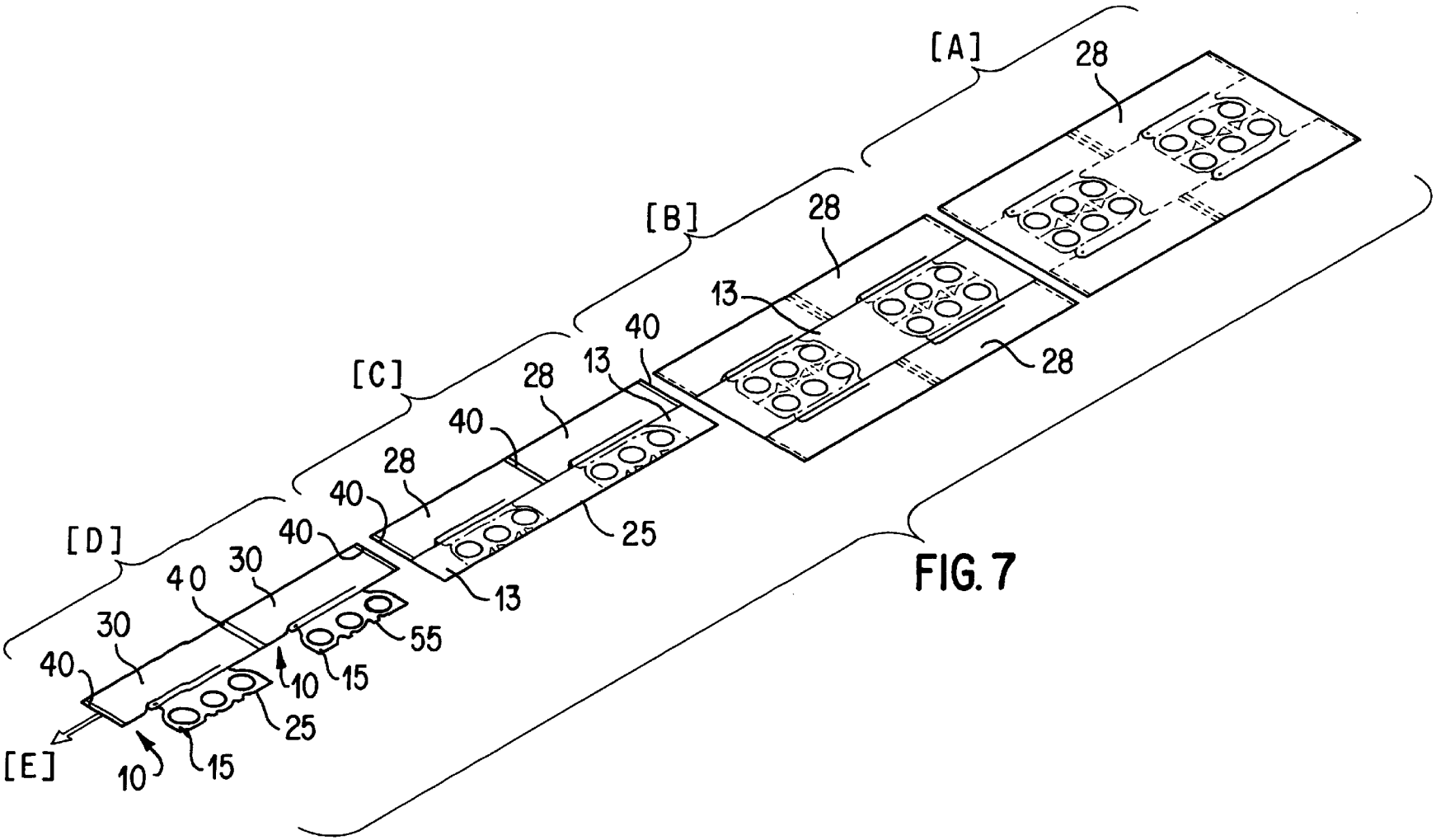
FIG. 7 is a schematic of a method for making a carrier, similar to the carriers shown in FIGS. 2 and 3, for holding a plurality of containers according to another preferred embodiment of this invention.

FIGS. 6–8 show methods for manufacturing carrier 10 according to three preferred methods of this invention. The methods shown in FIGS. 6–8 demonstrate from right to left the assembly of various components of carrier 10, each step in the method designated by a letter of the alphabet. Each step of each method of manufacture includes two carriers 10 to demonstrate a representative segment of carriers 10 that are typically formed in a generally continuous length.

FIG. 6 shows a method for manufacturing carrier 10 according to one preferred embodiment of this invention. In step [A] film substrate 28 is printed with desired graphics and other merchandising information. In step [B] retainer sheet material 13 is joined to film substrate 28 by extrusion coating, laminating, profile extrusion or glueing retainer sheet material 13 to film substrate 28. In step [C] retainer sheet material 13 and film substrate 28 are folded along fold line 25 to create a symmetrical double layer. In step [D] seams 40 are added by heat sealing or laminating the symmetrical double layer of retainer sheet material 13 and film substrate 28 together. In step [E] carrier 10 is formed by cutting, such as in a punch press, the double layer of retainer sheet material 13 and film substrate 28 to define film sleeve 30 and retainer sheet 15. Step [F] (not shown) preferably comprises accumulating the continuous strip of carriers 10 by fan folding or rolling about a core. Carriers 10 according to this invention, regardless of the method of manufacture, are not conducive to winding on reels because of the variable thickness between film sleeve 30 and retainer sheet 15.

FIG. 7 shows a method for manufacturing carrier 10 according to another preferred embodiment of this invention. In step [A] film substrate 28 is printed with desired graphics and other merchandising information. In step [B] retainer sheet material 13 is joined to film substrate 28 by extrusion coating, laminating, profile extrusion, or glueing retainer sheet material 13 to film substrate 28. In step [C] retainer sheet material 13 and film substrate 28 are folded along fold line 25 to create a symmetrical double layer and seams 40 are added by heat sealing or laminating the symmetrical double layer of retainer sheet material 13 and film substrate 28 together. In step [D] carrier 10 is formed by cutting, such as in a punch press, the double layer of retainer sheet material 13 and film substrate 28 to define film sleeve 30 and retainer sheet 15. Step [E] (not shown) preferably comprises accumulating the continuous strip of carriers 10 by fan folding or rolling about a core.

FIG. 8 shows a method for manufacturing carrier 10 according to yet another preferred embodiment of this invention. In step [A] film substrate 28 is printed with desired graphics and other merchandising information. In step [B] retainer sheet material 13 is joined to film substrate 28 by extrusion coating or laminating retainer sheet material 13 to film substrate 28. In step [C] two identical sheets of retainer sheet material 13 and film substrate 28 are laminated together along lamination lines 42. Step [C] requires careful registration to align two identical portions of joined retainer sheet material 13 and film substrate 28 prior to lamination. In step [D] seams 40 are added by heat sealing or laminating the two identical sheets of retainer sheet material 13 and film substrate 28 together. In step [E] carrier 10 is formed by cutting, such as in a punch press, the two sheets of retainer sheet material 13 and film substrate 28 to define film sleeve 30 and retainer sheet 15. Step [F] (not shown) preferably comprises accumulating the continuous strip of carriers 10 by fan folding or rolling about a core.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A single-piece carrier for carrying a plurality of containers in a package, the carrier comprising:

a sheet of material having at least two laminated layers;

a retainer sheet portion of the sheet of material having a first thickness, the retainer sheet portion having a plurality of container receiving openings for stretchingly engaging an upper portion of each container of the plurality of containers;

a film sleeve portion of the sheet of material constructed of a stretchable material having a second thickness thinner than the first thickness, the film sleeve portion integrated with at least two longitudinal edges of the retainer sheet portion to form the single-piece carrier and to substantially cover four vertical sides of the package; and a seam positioned along at least one edge of the film sleeve.

2. The carrier of claim 1 wherein the plurality of container receiving openings are arranged in longitudinal rows and transverse ranks.

3. The carrier of claim 1 wherein the retainer sheet is more rigid than the film sleeve.

4. The carrier of claim 1 wherein the film sleeve comprises stretchable film.

5. The carrier of claim 1 further comprising the retainer sheet extrusion coated to the film sleeve.

6. The carrier of claim 1 further comprising the retainer sheet laminated with the film sleeve.

7. The carrier of claim 1 further comprising a line of perforation across the film sleeve.

8. A package of a plurality of containers, the package comprising:

a variable thickness sheet of material having a first thickness and a second thickness;

a retainer sheet portion of the variable thickness sheet of material having the first thickness, the retainer sheet portion having a plurality of container receiving openings;

a plurality of containers, each container receiving opening of the plurality of container receiving openings stretchingly engaged with a container of the plurality of containers;

a film sleeve portion of the variable thickness sheet of material constructed of a stretchable material having the second thickness thinner than the first thickness, the film sleeve portion positioned around the plurality of containers to substantially cover four vertical sides of the package, the film sleeve portion integrated with the retainer sheet portion to form a single-piece carrier; and a seam positioned along at least one edge of the film sleeve portion.

9. The package of claim 8 wherein the film sleeve covers at least a portion of a bottom of the package.

10. The package of claim 8 wherein the plurality of container receiving openings are arranged in longitudinal rows and transverse ranks.

11. The package of claim 8 wherein the film sleeve is integrated with two longitudinal sides of the retainer portion.

12. The package of claim 8 wherein the film sleeve is stretchingly engaged with the containers.

13. A single-piece carrier for carrying a plurality of containers in a package, the carrier comprising:

a variable thickness sheet of material;

a retainer sheet portion of the variable thickness sheet of material having a first thickness, the retainer sheet portion having a plurality of container receiving openings for stretchingly engaging an upper portion of each container of the plurality of containers; and a film sleeve portion of the variable thickness sheet of material having a second thickness thinner than the first thickness, the film sleeve portion having a seam positioned along at least one edge and integrated with at least two longitudinal edges of the retainer sheet portion to form the single-piece carrier and to substantially and stretchably cover four vertical sides of the package.

14. A package of a plurality of containers, the package comprising:

a sheet having at least two laminated layers of material;

a retainer sheet portion of the sheet having a first thickness, the retainer sheet portion having a plurality of container receiving openings;

a plurality of containers, each container receiving opening of the plurality of container receiving openings stretchingly engaged with a container of the plurality of containers; and a film sleeve portion constructed of a stretchable material having a second thickness thinner than the first thickness, the film sleeve portion positioned around the plurality of containers to substantially cover four vertical sides of the package, the film sleeve portion integrated with the retainer sheet portion and having a seam positioned along at least one edge.

* * * * *